US007485218B2

(12) United States Patent
Dussich, I

(10) Patent No.: US 7,485,218 B2
(45) Date of Patent: Feb. 3, 2009

(54) STORM WATER FILTRATION SYSTEM

(75) Inventor: George Victor Anthony Dussich, I, Merritt Island, FL (US)

(73) Assignee: EcoSense International, Inc., Merritt Island, FL (US)

( * ) Notice: Subject to any disclaimer, the term of this patent is extended or adjusted under 35 U.S.C. 154(b) by 293 days.

(21) Appl. No.: 11/385,089

(22) Filed: Mar. 21, 2006

(65) Prior Publication Data

US 2006/0207922 A1 Sep. 21, 2006

Related U.S. Application Data

(60) Provisional application No. 60/664,149, filed on Mar. 21, 2005.

(51) Int. Cl.
*E03F 5/06* (2006.01)
*E03F 5/14* (2006.01)

(52) U.S. Cl. ..... 210/164; 210/85; 210/87; 210/130; 210/248; 210/255; 210/262; 210/434; 210/456; 210/502.1; 210/908; 210/691

(58) Field of Classification Search ..... None
See application file for complete search history.

(56) References Cited

U.S. PATENT DOCUMENTS 1,471,819 A * 10/1923 Bauschard ..... 210/247
1,686,415 A * 10/1928 Lyes ..... 210/247
2,182,795 A * 12/1939 Day ..... 210/164
2,796,988 A * 6/1957 Loffler ..... 210/135
4,261,823 A * 4/1981 Gallagher et al. ..... 210/164
4,263,138 A * 4/1981 Kessel ..... 210/163
4,594,157 A * 6/1986 McGowan ..... 210/163

(Continued)

*Primary Examiner*—Robert James Popovics
(74) *Attorney, Agent, or Firm*—James H. Beusse; Beusse Wolter Sanks Mora & Maire, P.A.

(57) ABSTRACT

A storm water filtering system located in a storm water catch basin, the basin having a storm water inlet spaced from at least one storm water outlet and defining a chamber for storm water collection between the inlet and the outlet. The filtering system comprises a plate for dividing the basin into a first chamber for receiving storm water and a second chamber for passing storm water out of the basin and a filter assembly mounted within a hole formed in the plate, the filter assembly including a filter media having a predetermined effective flow rate for removing pollutants from the storm water. The system further includes at least one overflow tube coupled to the plate at another hole formed therein for passing storm water through the plate and bypassing the filter assembly. The overflow tube has a storm water inlet at a height above the filter media so as to limit the maximum water pressure applied to the filter media. The overflow tube also includes a diverter lid mounted to a top of the overflow tube. The diverter lid has downwardly depending sides spaced from and overlapping the storm water inlet in the overflow tube such that pollutants floating on a surface of the storm water when the storm water is above the level of a lower edge of the lid sides does not enter into the overflow tube. In another form, the system includes a plurality of filter assemblies mounted within corresponding ones of a plurality of holes in the plate wherein the number of filter assemblies is determined by matching the outflow rate of the catch basin to the maximum effective filtering rate of the filter assemblies.

9 Claims, 7 Drawing Sheets

U.S. PATENT DOCUMENTS 4,682,907 A * 7/1987 Gaudin ..... 404/25
4,743,368 A * 5/1988 Gates ..... 210/163
4,776,722 A * 10/1988 Gaudin ..... 404/25
4,988,235 A * 1/1991 Hurley ..... 405/50
5,037,541 A * 8/1991 Ruey-Jang et al. ..... 210/141
5,069,781 A * 12/1991 Wilkes ..... 210/164
5,297,367 A * 3/1994 Sainz ..... 52/12
5,364,535 A * 11/1994 Buckalew ..... 210/671
5,511,904 A * 4/1996 Van Egmond ..... 405/52
5,605,622 A * 2/1997 Ferraro ..... 210/167.12
5,707,527 A * 1/1998 Knutson et al. ..... 210/660
5,762,790 A * 6/1998 Zoeller ..... 210/238
5,820,762 A * 10/1998 Bamer et al. ..... 210/661
5,849,181 A * 12/1998 Monteith ..... 210/163
5,904,842 A * 5/1999 Billias et al. ..... 210/162
5,925,241 A * 7/1999 Aldridge et al. ..... 210/163
5,985,157 A * 11/1999 Leckner et al. ..... 210/747
6,080,307 A * 6/2000 Morris et al. ..... 210/163
6,106,707 A * 8/2000 Morris et al. ..... 210/163
6,120,684 A * 9/2000 Kistner et al. ..... 210/163
6,217,757 B1 * 4/2001 Fleischmann ..... 210/163
6,231,758 B1 * 5/2001 Morris et al. ..... 210/163
6,254,770 B1 * 7/2001 Remon ..... 210/163
6,270,663 B1 * 8/2001 Happel ..... 210/163
6,406,620 B1 * 6/2002 Rogers ..... 210/155
6,503,390 B1 * 1/2003 Gannon ..... 210/164
6,521,122 B1 * 2/2003 Elliot et al. ..... 210/163
6,531,059 B1 * 3/2003 Morris et al. ..... 210/164
6,537,446 B1 * 3/2003 Sanguinetti ..... 210/163
6,562,233 B1 * 5/2003 Schilling et al. ..... 210/164
6,602,408 B1 * 8/2003 Berkey ..... 210/170.09
6,609,852 B2 * 8/2003 Wimberger ..... 405/40
6,743,354 B1 * 6/2004 Evans et al. ..... 210/164
6,793,811 B1 * 9/2004 Fleischmann ..... 210/163
6,997,636 B2 * 2/2006 Tremouilhac ..... 404/5
7,014,755 B2 * 3/2006 Muir et al. ..... 210/164
2001/0030150 A1 * 10/2001 Remon ..... 210/163
2003/0132150 A1 * 7/2003 Happel ..... 210/163
2005/0103694 A1 * 5/2005 Rost et al. ..... 210/164
2005/0183997 A1 * 8/2005 Happel et al. ..... 210/163
2005/0199537 A1 * 9/2005 Kluge ..... 210/164
2005/0230317 A1 * 10/2005 Belasco et al. ..... 210/691
2005/0247612 A1 * 11/2005 Glassheim ..... 210/163
2006/0049085 A1 * 3/2006 Parker ..... 210/163
2006/0207922 A1 * 9/2006 Dussich ..... 210/164

* cited by examiner

STORM WATER FILTRATION SYSTEM

SPECIFIC DATA RELATED TO THE INVENTION

This application claims the benefit of U.S. provisional application No. 60/664,149, filed Mar. 21, 2005.

The present invention relates to a surface/storm water filtration system for removing debris, petroleum hydrocarbons and soluble chemicals from storm water runoff.

In urban and industrial areas during rainstorms, water that is not absorbed into the ground runs off into storm sewer systems. In some systems, the run-off may be transported to water treatment facilities. However, in most instances, excess water is directed into local streams, rivers, ponds or wetlands. The storm-water runoff carries debris and pollutants into the storm and sewer systems. Pollutants may include oil and other hydrocarbons, particulate matter such as sand and grit, and miscellaneous debris such as vegetative matter, paper, plastic, and foam cups. For environmental protection, it is desirable to have some form of separation or filtering system in the storm water sewer system.

Different types of separation systems have been used, many of which rely on baffles and traps to cause the particulate matter in the storm water run-off to settle. One problem with such traps is that they are less effective at the time in which they are most needed, i.e., when the run-off is at its highest rate. During such time periods, the water tends to be the most turbulent and the particulate matter has less time to settle. In addition, the systems are forced to have by-pass capacity so that a back-up of the sewer system does not occur when a particularly strong storm is passing. The by-pass system allows all of the pollutants in the storm water to by-pass the separating system.

DETAILED DESCRIPTION OF THE INVENTION

The present invention provides a filtering system for storm water run-off that minimizes the amount of pollutant that bypasses the filtering system during periods of high flow rates.

Figure 1:
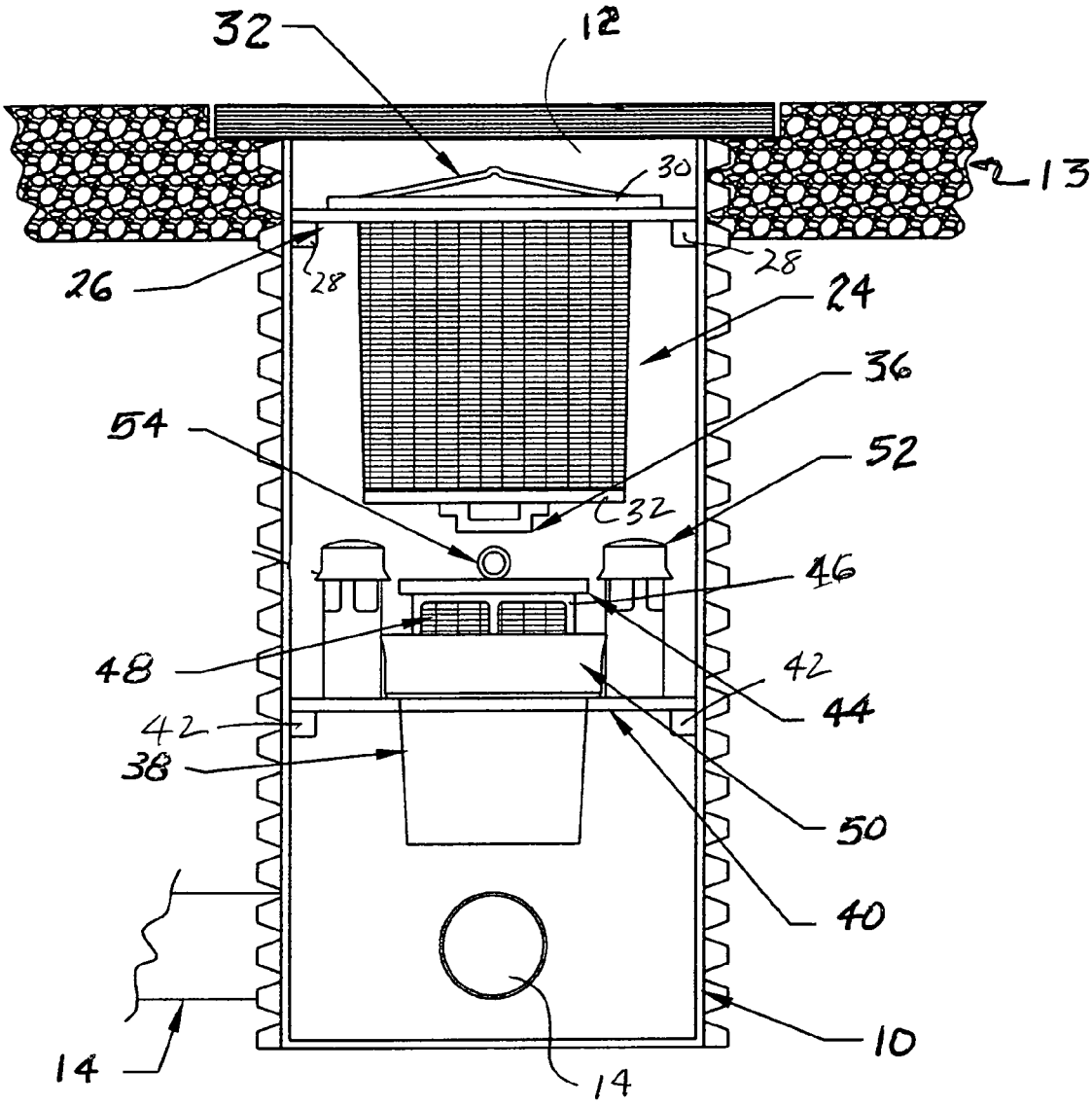
FIG. 1 is a cross-sectional view of a storm water catch basin incorporating a filtering system according to one embodiment of the invention.

Referring to FIG. 1, there is shown a cross-sectional view of a storm water catch basin incorporating one form of filtration system in accordance with the present invention. The inventive filtration system is installed in a conventional catch basin that is used in curb or street-side drainage systems in most cities. Typically, the catch basin 10 has an opening 12 located at curb-side of a street. The curb is indicated in cross-section at 14 and is typically a concrete material. At or near the bottom of the catch basin 10 there are typically provided discharge pipes 13 to drain the storm water from the catch basin into a storm water distribution system. The filtration system of the present invention is adapted to be installed in such catch-basins and to collect debris and hydrocarbons that are swept into the catch basin during rainstorms.

Figure 2:
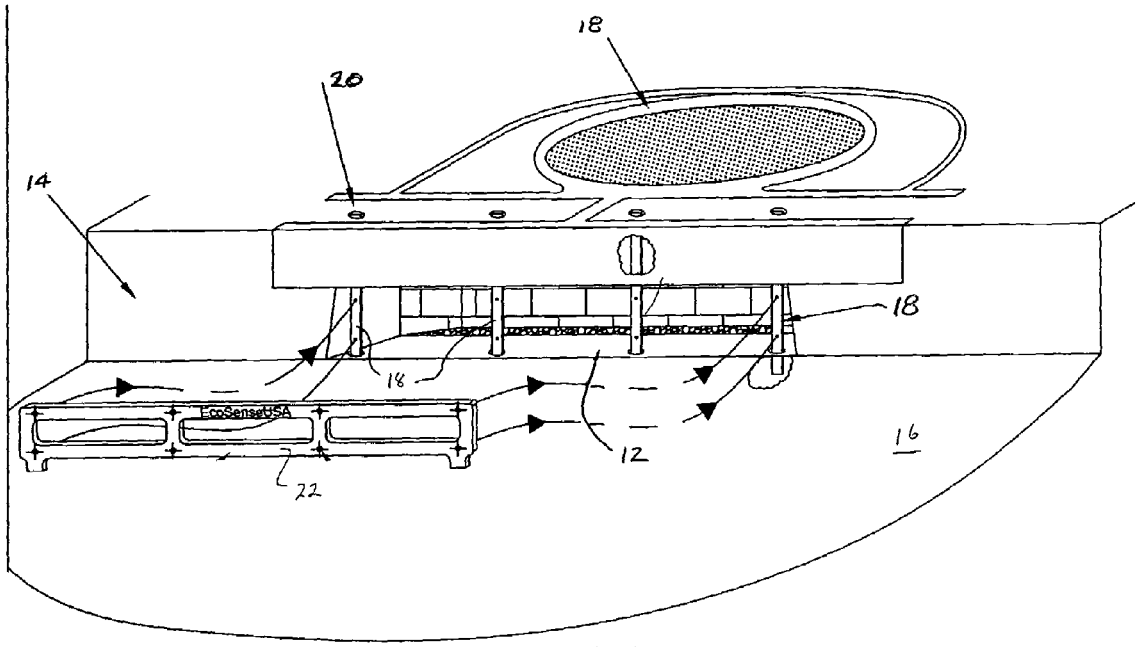
FIG. 2 illustrates a mechanical apparatus for minimizing egress of large items of debris into a catch basin.

Referring briefly to FIG. 2, there is shown an illustration of a typical curb side installation of a catch basin wherein the drain area 12 opens through the curb 14 to allow debris to be swept from the street 16 into the catch basin 10. Typically, each of the catch basins are topped by a man hold cover 18 that allows access to the catch basin. As part of the present invention, the access opening through the curb is provided with a plurality of brackets 20 that are positioned in holes 22 drilled through the top portion of the curb and into the underlying street 16 so as to firmly fix the brackets in the opening 12. The brackets 18 provide a support for an external grate 22 which provides an initial filtering means for large objects that may be washed towards the opening 12. The grate 22 blocks objects such as hubcaps and large plastic cups from entering into the catch basin 10. Referring back to FIG. 1, within the catch basin there is provided an initial debris basket 24 to catch the objects which are not stopped by the external grate 22. The basket 24 is supported on a basket support plate 26 which is supported on mounting brackets 28 attached within the catch basin 10. The basket 24 fits within a cut out section within the plate 26 and has an upper integral support flange 30 which rests on the support plate 26. The basket 24 is open at the top so that the larger objects may fall into the basket and is provided with a top pullout handle 32 to enable the basket to be removed for dumping the debris caught within the basket. The bottom 34 of the basket 24 may be solid and provided with another handle 36 to facilitate handling of the basket for turning upside down and dumping the debris therefrom. In one form, the basket 24 may be formed of a wire mesh material having ½ inch or ⅜ inch openings so that the larger debris is caught within the basket while the smaller items may filter out.

Located beneath the basket 24 is another portion of the filtration system comprising a filter canister 38 which incorporates a filter media that is selected to filter out micron sized particles such as petroleum hydrocarbons that may be captured during the initial surge of storm water washing off of a street. The filter canister 38 is supported by a second filter support plate 40 also mounted within the catch basin 10 using the support brackets 42. At the top of the filter canister there is attached a chamber defined by a top diversion lid 44 and a support means extending down to and connected to the filter canister. The support means indicated at 46 also includes a plurality of openings in which there is located another debris screen 48. The debris screen 48 is designed to have openings which are much smaller than the openings in the debris basket 24. Typically, it is contemplated that the debris screen 48 would have openings that are approximately ¼ inch. The filter canister 38 incorporates a snap ring type fitting 50 which has a functional shape to divert sediment to the side areas and also provides a seal to prevent water from flowing around the upper portion of the canister and bypassing the filter media. However, it should also be noted that the filter support plate 40 is provided with additional overflow tubes 52 having openings higher than the openings in the debris screen 48 so that if the water flowing into the catch basin exceeds the capacity of the filter canister 38, the water can bypass the canister and flow into the discharge pipes 14 through the overflow tubes 52. The lid 44 on the filter canister is also provided with a lifting and weighing eyelet to allow the canister to be lifted out of the catch basin for replacement once the filter media has become saturated or to weigh the canister to determine if the media is saturated with pollutants.

Figure 3:
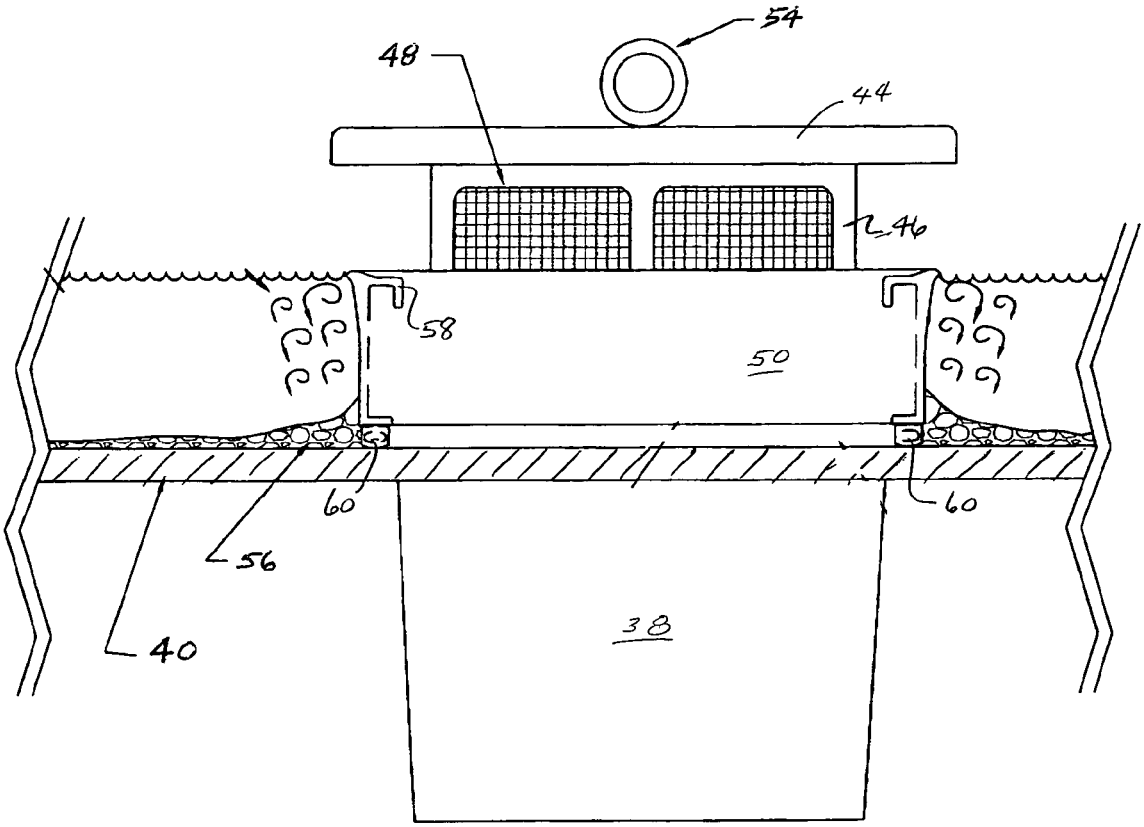
FIG. 3 is a partial view of the system of FIG. 1 showing mounting of a filter canister.
Figure 5:
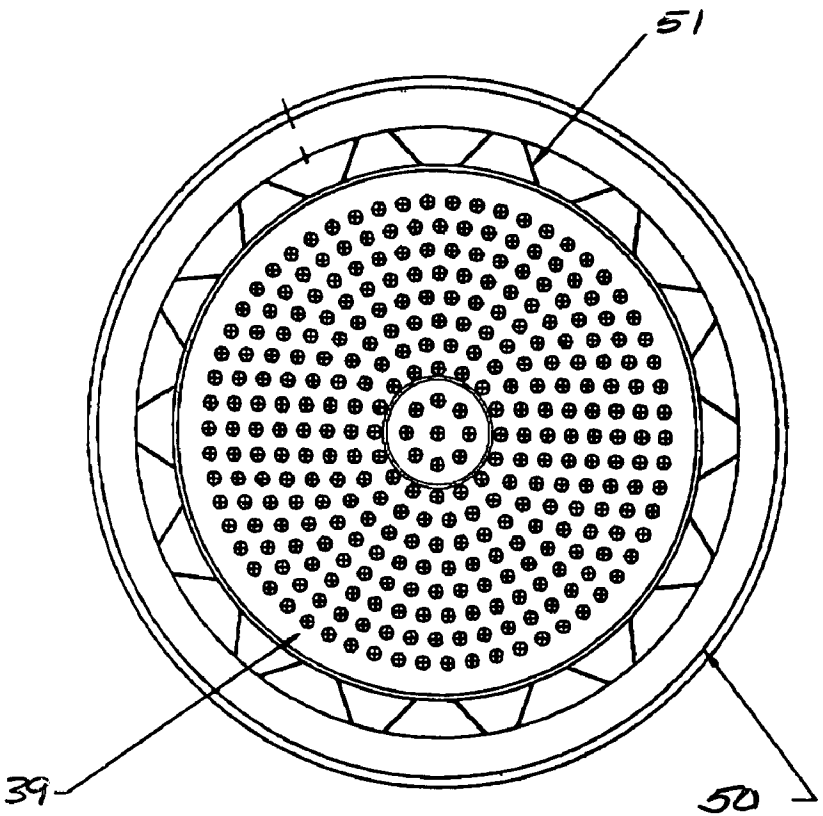
FIG. 5 is a top plan view of the canister of FIG. 3 2ith the canister support installed.
Figure 4:
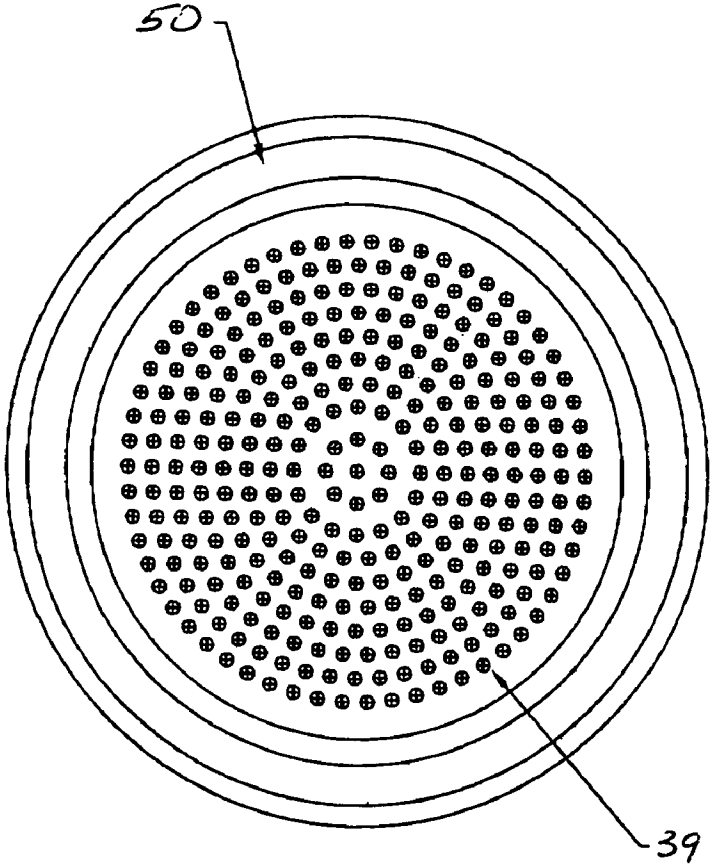
FIG. 4 is a top plan view of a filter canister of the type shown in FIG. 3.

Referring to FIG. 3, there is shown a partial view of the filter canister 38 illustrating how the snap ring 50 is utilized to capture debris within the space outside the snap ring 50. In particular, the snap ring 50 has an outer shape defining a slightly concave surface that generally underlies the outer edges of the diversion lid 44. Consequently, water flowing out of the upper debris basket 24 falls down over the diversion lid 44 and into the area between the ring 50 and the confines of the catch basin 10. The falling water creates a rotation similar to a venturi effect which tends to cause the water to circulate in the area between the ring 50 and the sides of the catch basin and assist in causing sediment and other larger particles to fall to the bottom and be caught on the support plate 40. The sediment is indicated at 56. The effect is therefore to minimize the amount of material that actually is drawn through the debris screen 48 of the filter canister. The top portion of the filter canister comprising the diversion lid and debris screen 48 are coupled to the filter canister by means of the snap ring 50. Note that the inner surface of the snap ring has an overlying flange 58 which captures a corresponding flange (not shown) on the support 46. The overall combination of the support 46 and filter canister 38 remain in position within the support plate 40 due to the weight of the assembly. The gasket 60 provides the seal to prevent the debris and water from bypassing the filter canister under normal operation. FIGS. 4 and 5 are top and bottom plan views of the filter canister 38. FIG. 4 shows the holes 39 in the canister for admitting and discharging water flowing through the filter media. The holes are sized smaller than the holes in the debris screen 48 in order to further limit the size of the particles that are captured within the filter media. FIG. 5 shows the snap ring 50 and support 51.

Figure 6:
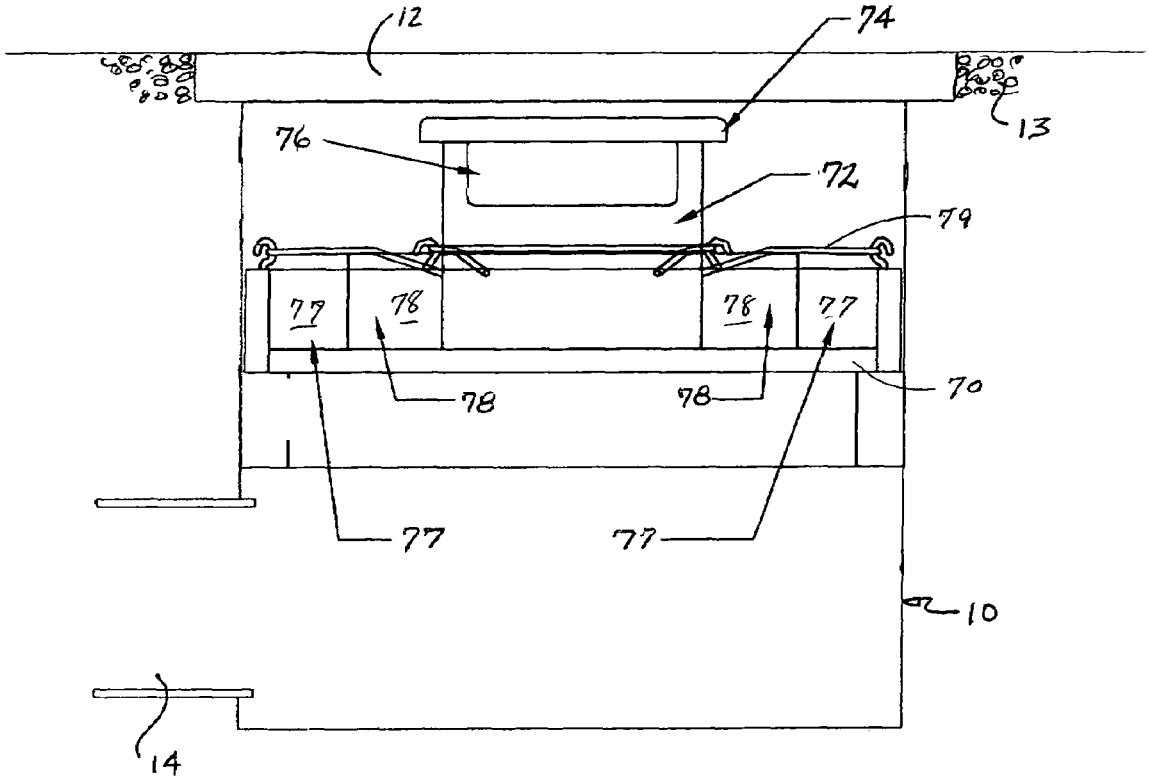
FIG. 6 is another embodiment of the filter system of FIG. 3.
Figure 7:
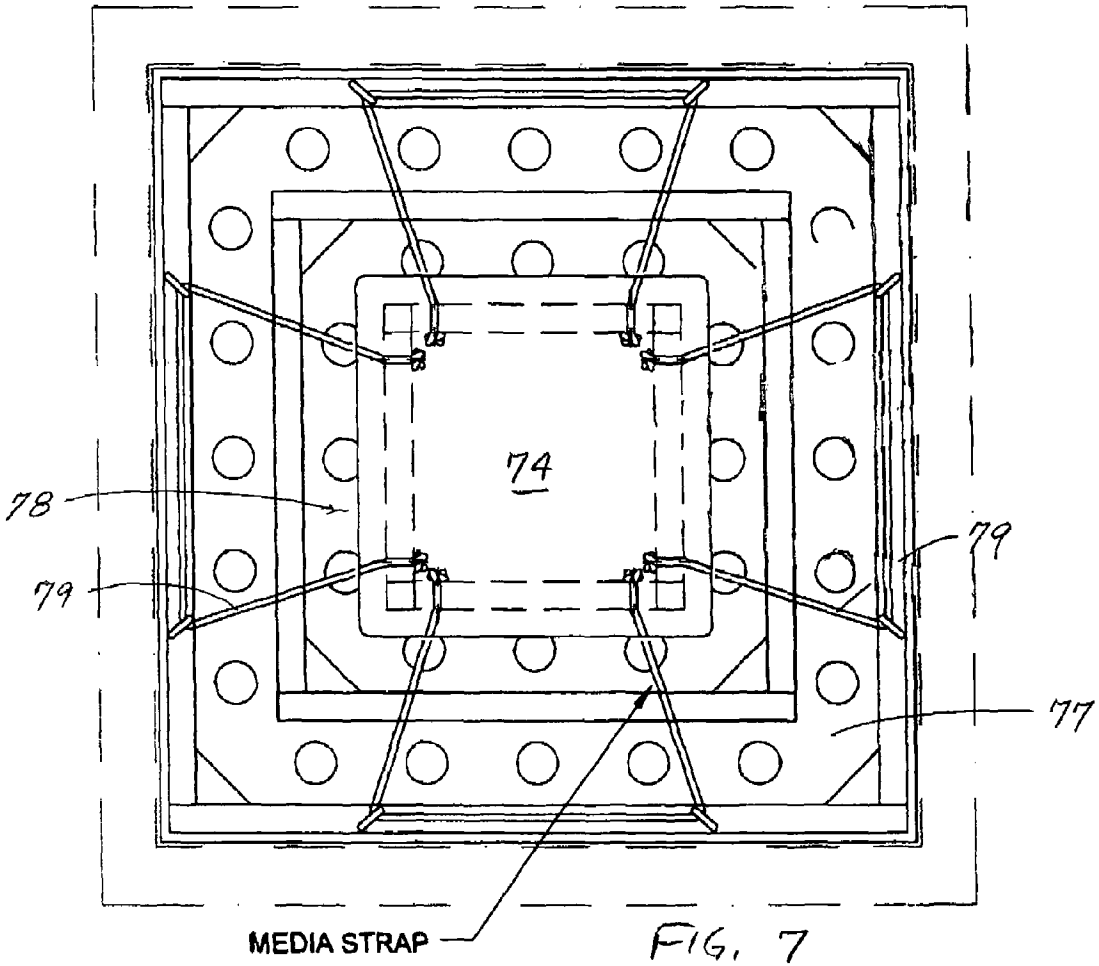
FIG. 7 is a top plan view of the system of FIG. 6.

Having described generally the concept and elements of the present invention, it should be noted that the invention is not limited to the particular circular configurations illustrated but could be formed in rectangular or other shapes depending upon the particular application and/or the shape of the catch basin in which the system is to be installed. In addition to the embodiments illustrated in FIGS. 1-5, it is also contemplated that the system could be incorporated in a single stage arrangement using a smaller grating to block larger debris from entering the catch basin. In this form, as shown in FIGS. 6-7, a support plate 70 supports an overflow bypass structure 72 having a diversion lid 74 to prevent water from falling directly into the overflow bypass. The bypass opening under the diversion lid is indicated at 76. Surrounding the structure 72 are two sets of media chambers 78 and 77. The media within the chambers 78 and 77 may be held in place by means of plastic or wire straps 79. Each of the media chambers 78, 77 have covers with holes formed therein to allow debris carrying water to enter the media chambers. FIG. 7 is a top view of the system of FIG. 6 showing the plan configuration.

The elements within the filtration system may be formed of a high density polyethelyne since such material is more impervious to many of the elements found in storm water runoff than metal, such as aluminum or stainless steel. It should be noted that the configuration of the initial grate 22 is such that allows plastic bags and leaves to pass underneath into the basin but stops most litter such as paper, plastic cups, soda or beer cans and bottles and large wads of paper or foam material. The grate is firmly fixed by use of the brackets 18 which may be stainless steel rather than high density polyethelyne.

Although it is preferred to use high density polyethelyne, it would be appreciated that the mesh material of the debris baskets are preferably stainless steel supported on high density polyethelyne frames. The debris basket 24 catching the larger material can be very large including 20 to 30 gallon capacity with full size flow ability. The upper lift handle makes the basket easily accessible and removable from the catch basin using the same types of tools that may be used to remove the man hole cover. The system can also be provided with lock down cleats to secure the basket and insure that it cannot be used by unauthorized persons.

It should be noted that the hydrocarbon filtration canister 38 is designed so that all incoming first flush storm water, i.e., the initial volume of run off produced by rain, is directed through the canister. During this first flush period of a rain even, rain water wets impervious surfaces such as streets, parking lots and roofs. Pollutants picked up and suspended in the surface water are collectively termed total suspended solids and include items such as petroleum based hydrocarbons (oils, fuels, solvents, etc.), soluble trace metals, pesticides, fertilizers, silt, leaves, grass clippings, cigarette butts and trash. These contaminants are carried to storm water drainage systems which eventually lead to rivers and other water collection areas. The inventive filtration system catches these pollutants in three stages before it enters the drainage system and prevents its release into normal waterways. In summary, the system uses a three-stage filtering arrangement in which there is an inlet throat grate at the street or parking lot level to catch larger trash items before they enter into the storm water collection basin. The debris basket within the basin then captures all debris entering the basin that is larger than approximately ½ inch in diameter. Items such as grass clippings, small leaves, cigarette butts, hypodermic syringes, candy wrappers and bottle caps will be caught in this debris basket. Finally, the filtration canister removes the fine particles from the storm water. The filtration canister uses a media which can remove most materials and sediments that are larger than 5 micron from the first flush storm water.

It should also be noted that the system utilizes a snap ring that has a special flared venture design in its upper edge to force a greater amount of the sediment in turbulent water to settle down around the outside perimeter of the filtered canister on top of the support plate. In addition, the filter canister is fitted with a removable debris screen and diversion lid which prevents trash from blocking the filter reduces fire hazards by diverting cigarette and cigar butts away from the filter medium. The diversion lid is secured to the filter canister by a single eye bolt that also serves as a lifting ring enabling service personnel to lift and weigh the filter if it is saturated and time for replacement. The filter canister media chamber can be filled with whatever media is appropriate for a specific application or removal of specific pollutants.

The inventive system utilizes two support plates to position the filter canister that catches the larger debris at a higher level so that it is easier to remove and clean. It is anticipated that this filter canister would be emptied more often than is necessary to replace the filter media. The filter media captures the smaller debris and the state of the media, i.e., whether it is still capable of absorbing more pollutants, can be determined by simply weighing the filter canister.

The system of the present invention is characterized by at least three unique features. These features are:

Regulation of water flow through a storm water/wash water filter by adjustments to the height of the over-flow/bi-pass mechanism. In the illustrated embodiment this mechanism comprises an over-flow tube or OFT.

The inclusion of a diversion lid ("DL") that prevents surface water and floating contaminates from entering the flow regulating over-flow/bi-pass mechanism.

Method of determining the contaminate load of and the point when a storm water/wash water filter's useful function has expired. In the illustrative embodiment this mechanism comprises a contaminate load indicator or CLI.

It is known that a filter medium designed to remove contaminates from water will have filtration efficiency generally proportional to the length of time the water is in contact with the medium. That is, the slower water is passed through the filter, the greater will be the contaminate removal efficiency. It is also commonly known that if water is forced through a filter medium at a high velocity, mechanical forces will dislodge contaminates previously trapped by the medium. Accordingly, it is desirable to control the flow rate through a filter to maximize filtration efficiency and at the same time prevent contaminates from being flushed out of the filter medium.

It is also known that most petroleum based hydrocarbons such as oils and greases will float on the surface of water and that many pollutants are attached to floatable materials found in storm and surface water. These materials also may cause storm water conduits, wells and French drains to clog and diminish water flow. Accordingly, it is desirable to prevent these materials from reaching waterways or groundwater via storm water conduits, French Drains or drainage wells.

In any filtration system including a storm water/wash water filtration system, it is commonly understood that the filters and/or filter media must be replaced when the contaminate load has reached the filter's capacity to insure proper and efficient performance of the system. When the filter or filter media is saturated with contaminates the system may 1) release trapped contaminates to the water stream, 2) allow contaminates to pass through the media and/or 3) clog and reduce the media's ability to allow the passage of water. Accordingly, it is desirable to provide a mechanism for easily determining a filter's degree of contaminate load.

Figure 8:
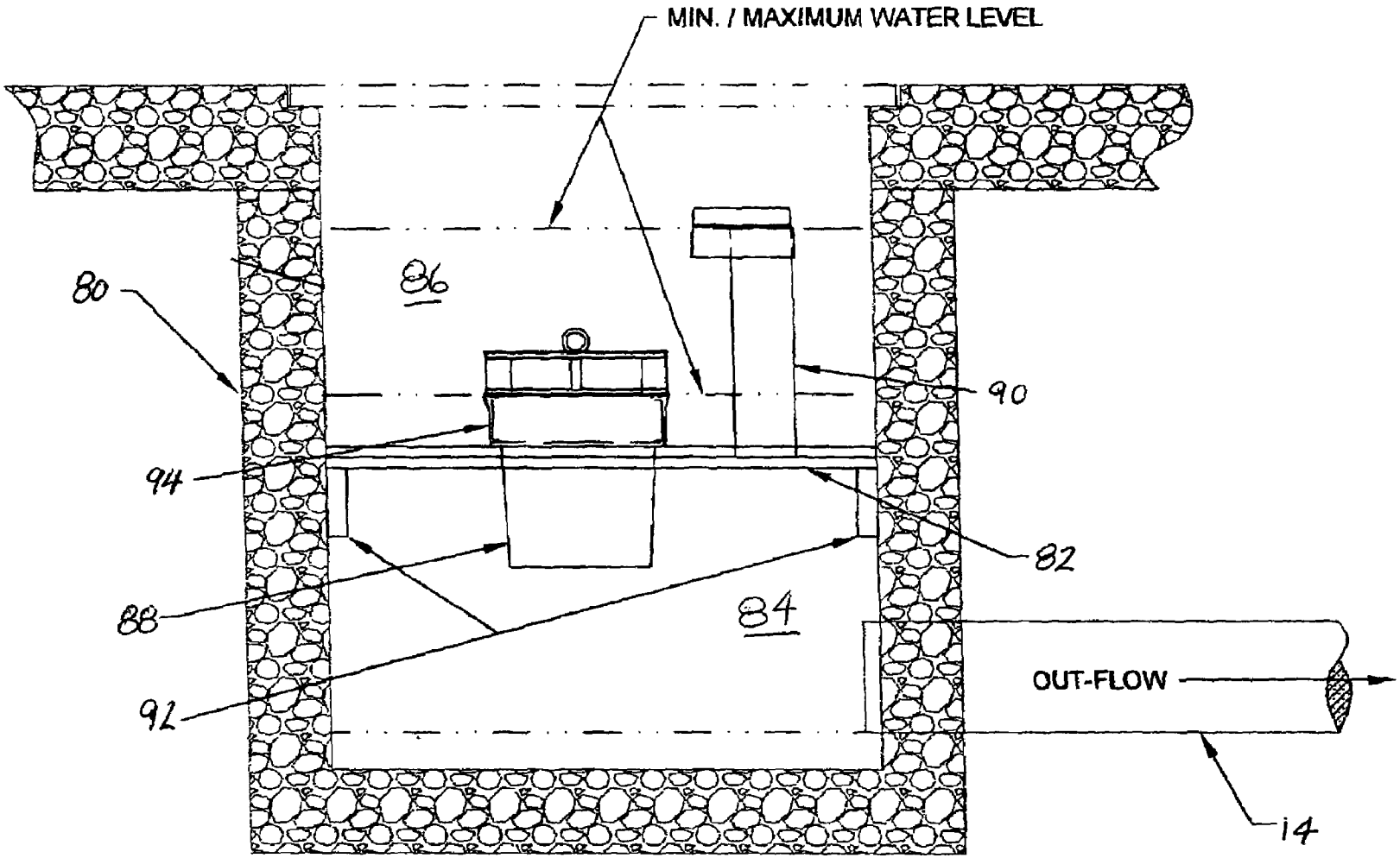
FIG. 8 is a simplified embodiment of the system of FIG. 1.

As has been described above, the filtration system in accordance with the present invention is installed into a typical drainage or catch basin 80 that receives storm water, wash water or industrial runoff water. The water may enter the system from above in the common type systems but could also enter from the side or bottom of the basin. Referring to FIG. 8, the system comprises a support plate 82 that divides the basin 80 into two chambers 84 and 86. One or more filters assemblies 88 and OFT's 90 are mounted to the support plate 82. The plate 82 is designed and installed so that water cannot pass from one of the chambers 84, 86 to the other of the chambers without passing through either a filter assembly 88 or an OFT 90. In one form the support plate 82 may be a relatively heavy metal plate that seats on cleats 92 fastened to the walls of the basin 80. The plate 82 may be bolted or otherwise secured to the cleats 92 to prevent movement during large water volume flow. The plate 82 has a plurality of shaped openings for receiving a corresponding plurality of filter assemblies 88 and OFT's 90 as are necessary to handle the volume of water expected to flow into the catch basin 80. The filter assemblies 88, which may be in the configuration of the canisters 38 of FIG. 1, drop directly into the cutouts or openings in the plate 82 and are supported by a snap ring flange 94. As shown in FIG. 3, each canister or filter assembly 88 is fitted with a gasket 60 that seals the canister against the support plate 82. The OFT's 90 are pressed and bonded into the support plate 82 in corresponding openings sized and configured to provide a generally leak free connection between the plate and OFT.

In order to determine the desired size, number and flow capacity of the filter assemblies 88 and the OFT's 90 for any particular basin 80, it is necessary to know the basin's total out-flow capacity and the usual "first flush" volume. In some cases it may be desirable to remove certain pollutants such as heavy metal ions that may require a special filter media for the canister. The basin's out-flow capacity is related to the size and number of discharge pipes 96 attached to it. The first flush is the initial volume of water from an average rain event, measured in depth of rainfall per time per area. The first flush water washes away many pollutants that are deposited onto ground, parking lot, street, and roof top surfaces. The majority of pollutants entering the waterways are found in this first flush runoff. Polluted water entering the basin is directed through the filter assembly 88 to be cleansed before passing down stream via the discharge pipes 96. Given the first flush volume, the number and size of the filter assemblies can be chosen to provide a flow rate that will allow the first flush volume to be filtered through the assemblies 88 before any of the water is bypassed through the OFT 90. After the first flush, if the runoff volume exceeds the capacity of the filter assembly or assemblies, the water will rise in the upper basin chamber 86 until it reaches the top of the OFT 90 and then flow directly into the lower chamber 84, bypassing the filter assembly. Preferably, the number and size of the OFT's 90 is selected to assure that their discharge capacity matches the discharge capacity of the basin so that the filtration system does not contribute to overflow of the basin.

The overflow tube or OFT 90 comprises a vertical tube or conduit mounted on the support plate 82. The height of the OFT 90 above the plate 82 (actually above the top of the filter media within the filter assembly 88) determines maximum water depth and therefore, the head pressure that pushes the water through the filter media. As an example, one specific cartridge/medium combination performs efficiently at a range of 7.14 bed volumes per minute or 0 to 25 gallons per minute (GPM). Over 25 GPM the filters' efficiency drops below 85%. To limit this filter's flow rate to a maximum of 25 GPM, the water height above the media should be designed to not exceed about 16 inches. Accordingly, the OFT 90 would be designed with an entrance or overflow port that is typically 16 inches above the filter's media bed.

The overflow port into the OFT 90 is protected by a diversion lid 98 ("DL") in the form of a large cap having an irregularly shape that is fastened to the top of the OFT 90. As shown in FIG. 8, the DL 98 may be fastened to the OFT with an offset. The sides 98*a* extend downward below the level of the overflow port into the OFT. In one form the lower edge of the sides 98*a* may be at least two inches below the lowest point of entry into the overflow port. This creates an effective blocking mechanism to prevent floating oil and debris from entering the OFT once the water level has risen to the height of the overflow port into the OFT. The only portion of surface water allowed to enter the OFT will be equal to the area of the DL's entry port when the water initially rises. The surface water and the floatable pollutants associated with it will remain in the upper chamber 86 above the support plate 82 and be stored until the storm event diminishes. The filter assembly 88 will then allow the surface water to pass through and trap the pollutants.

The filter assembly 88 is preferably provided with a contaminate load indicator or CLI that can measure the contaminate load of the filter media by weight without taking the filter out of service. Once the weight of the clean filter assembly and the weight of fully saturated filter assembly are known, both numbers that are readily obtained by measurement, any common mechanical method can be used to determine if the filter has reached its saturation point or ever to determine the percent of remain filter usefulness. For example, one exemplary filter assembly weighs 11.2 lbs. including its debris screen and diversion lid and through laboratory testing, it is known that the media contained in the filter will capture and retain at least 12.5 lbs. of petroleum-based hydrocarbons. By incorporating a spring loaded ring into the support plate 82 around the filter cutout, so that a flange of the snap ring 50 (see FIG. 1) rests upon it, the filter canister 38 will move downward as its' increasing weight compresses the spring loaded ring. The position of the canister can then be noted by direct measurement from above or a sealed microswitch can be positioned to be contacted by the canister at some desired point to provide an electrical signal using a battery when the media is filled. The micro-switch can be placed underneath the support plate near the edge of the filter cutout. A small actuator rod can be set loosely in a hole above the micro-switch so that when the filter drops it will push the rod against the micro-switch to complete the circuit to the LED. The light can be placed in a location easily viewed from above the basin through the grate or attached to a nearby structure. The light could be designed to flash on and off periodically to attract attention and conserve battery power. It will also be possible to attach the micro-switch/battery system to a wireless transmitter so the signal may be observed in a remote location.

While the invention has been described in what is presently considered to be a preferred embodiment, it will be recognized that various modifications may be employed without deviating from the scope of the invention. It is intended therefore that the invention not be limited to the specific disclosed embodiments but be interpreted within the spirit and scope of the appended claims.

What is claimed is:

1. A storm water filtering system located in a storm water catch basin, the basin having a storm water inlet spaced from at least one storm water outlet and defining a chamber for storm water collection between the inlet and the outlet, the filtering system comprising:

a plate for dividing the basin into a first chamber for receiving storm water and a second chamber for passing storm water out of the basin;

a filter assembly mounted within a hole formed in the plate, the filter assembly including a filter media having a predetermined effective flow rate for removing pollutants from the storm water;

an overflow tube coupled to the plate at another hole formed therein for passing storm water through the plate and bypassing the filter assembly, the overflow tube having a storm water inlet at a height above the filter media so as to limit the maximum water pressure applied to the filter media; and a diverter lid mounted to a top of the overflow tube, the diverter lid having downwardly depending sides spaced from and overlapping the storm water inlet in the overflow tube such that pollutants floating on a surface of the storm water when the storm water is above the level of a lower edge of the lid sides cannot enter into the overflow tube.

2. The storm water filtering system of claim 1 and including a plurality of filter assemblies mounted within corresponding ones of a plurality of holes in the plate, the number of filter assemblies being determined by matching the outflow rate of the catch basin to the maximum effective filtering rate of the filter assemblies.

3. The storm water filtering system of claims 2 and including a plurality of overflow tubes mounted to the plate, the bypass volume of the overflow tubes being selected to match the effective filtering rate of the filter assemblies such that the water head pressure at the filter media does not exceed a selected maximum value.

4. The storm water filtering system of claim 3 wherein each of the overflow tubes includes a diverter lid mounted to a top of the overflow tube, the diverter lid having downwardly depending sides spaced from and overlapping a storm water inlet in the overflow tube such that pollutants floating on a surface of the storm water when the storm water is above the level of a lower edge of the lid sides does not enter into the overflow tube.

5. The storm water filtering system of claim 1 wherein the filter assembly includes a canister containing a filter media, the canister protruding through the plate, and an enlarge support attached to an upper end of the canister for support the canister against an upper surface of the plate, the system further including apparatus coupled to the support for determining the weight of pollutants captured in the filter media.

6. The storm water filtering system of claim 5 wherein the apparatus for determining the weight of the pollutants comprises;

a spring mounted between the support and the plate such that the spring is compressed by the weight of the pollutants; and means for determining the degree of compression of the spring.

7. The storm water filtering system of claim 5 and including a gasket positioned between the support and the plate.

8. The storm water filtering system of claim 1 and including a pre-filter mounted in the catch basin above the filter assembly, the pre-filter comprising a mesh basket for capturing large items of debris entering the basin.

9. A storm water filtering system located in a storm water catch basin, the basin having a storm water inlet spaced from at least one storm water outlet and defining a chamber for storm water collection between the inlet and the outlet, the filtering system comprising:

a plate for dividing the basin into a first chamber for receiving storm water and a second chamber for passing storm water out of the basin;

a plurality of filter assemblies mounted within corresponding ones of a plurality of holes formed in the plate, each of the filter assemblies including a filter media having a predetermined maximum flow rate at which the media is effective for removing pollutants from the storm water;

a plurality of overflow tubes coupled to the plate at respective spaced holes formed therein for passing storm water through the plate and bypassing the filter assemblies, the number of overflow tubes being selected to establish a flow rate corresponding to the expected first flush volume of flow into the catch basin, each of the tubes having a storm water inlet at a height above the filter media so as to limit the maximum water pressure applied to the filter; and a diverter lid mounted to a top of the overflow tube, the diverter lid having downwardly depending sides spaced from and overlapping the storm water inlet in the overflow tube such that pollutants floating on a surface of the storm water when the storm water is above the level of a lower edge of the lid sides cannot enter into the overflow tube.

* * * * *